US006045452A

United States Patent [19]

Ahn et al.

[11] Patent Number: 6,045,452

[45] Date of Patent: Apr. 4, 2000

[54] GOLF PUTTER WITH HORIZONTAL CONCAVITY IN STRIKING FACE

[76] Inventors: Stephen C. Ahn, 8809 South Lea Ct., Fairfax, Va. 22031; Suh Yong Lee, 4118 Amesbury La., Durham, N.C. 27707

[21] Appl. No.: 09/114,523

[22] Filed: Jul. 13, 1998

[51] Int. Cl.[7] ..... A63B 53/04; A63B 69/36

[52] U.S. Cl. ..... 473/249; 473/251; 473/330

[58] Field of Search ..... 473/324, 330, 473/331, 340, 341, 342, 231, 238, 249, 251, 252

[56] References Cited

U.S. PATENT DOCUMENTS 807,736 12/1905 Foulis .
1,211,708 1/1917 Hudson .
1,467,714 9/1923 Doerr .
1,674,173 6/1928 Haupt .
2,472,978 6/1949 Mahon .
3,328,032 6/1967 Griswold .
3,333,854 8/1967 White .
3,408,074 10/1968 Antonious .
3,881,733 5/1975 Csernits .
4,290,606 9/1981 Maxwell .
4,762,324 8/1988 Anderson .
4,846,477 7/1989 Phelan .
5,098,103 3/1992 Mackeil .

*Primary Examiner*—Sebastiano Passaniti
*Attorney, Agent, or Firm*—Alfred F. Hoyte, Jr.

[57] ABSTRACT

A golf putter has the hitting face with horizontally concave surfaces. The curvatures of the concave horizontal faces range arcs of five to one-foot radius circles.

5 Claims, 3 Drawing Sheets

GOLF PUTTER WITH HORIZONTAL CONCAVITY IN STRIKING FACE

FIELD OF THE INVENTION

This invention relates to an improved design of a golf putter. The improved putter enables a player to putt more accurately in a short putt situation; that is, within about five feet of the hole.

BACKGROUND OF THE INVENTION

Putting is very important in the game of golf. On a par-72 course, one-half (36) strokes are allotted for putting. Moreover, it does not take great strength or physical ability to be a good putter. For a golfer, one stroke on a green counts just as much as any other stroke in the course.

There are two kinds of putting—long putts and short putts. A long putt may be defined as any putting requiring more than five feet to reach the cup. If the ball lies within about five feet of the hole, it is a short putt. The primary objective of the long putting is to hit the ball so that it ends within approximately three feet of the hole. Although sinking the ball in a long put is pleasant and desirable, the primary goal on long putts should be placing the ball near enough of the hole so that the next stroke will easily make the hole. In addition, for the long putts many variables such as the slope of the ground, the accuracy of the aim, the length to be traveled, and speed of the ball comes into play. The accuracy of the aim, although critically important, only play a minor role in the overall success of the long putting. On the other hand, the accuracy is the most important factor in short putting. Other variables such as the slope of the ground, speed of the ball, and texture of the turf become less important.

A short putt is very important in a game of golf not only because a missed putt will cost a stroke, but the impact it has psychologically to a player. Because of its length, every golfer, pros and amateurs alike, feels compelled to make it. When he does not make it, he thinks he missed an easy shot. Consequently, it tends to destroy a player's confidence and may affect his concentration for rest of the game.

In a putting situation, the direction of the putt is dictated by the path of the clubhead and the face angle at impact. The path is important and affects direction, but the face angle of the putter at impact is also very important in determining direction. Providing the green within five feet of the hole has no significant slope and texture of the turf is uniform, successful short putting should require the path of the clubhead directly aimed to center of the hole, and club face angle precisely perpendicular to the line between clubhead and the hole. In addition, the center of the ball should be precisely aligned with the marker on top of the putter that generally indicates location of the center of gravity in the toe to heel direction. An infinitesimal deviation from these is the reason for a miss of the short putt. To miss the hole that is four inches wide, from five feet distance the deviation of a face angle from perpendicular to the straight line to the hole must be so small it will not be discernable to the naked eyes. Every player carefully adjusts the face angle of the putter and aligns the ball to the center of gravity marker before he strokes the ball. Nevertheless, a putt is missed because the face of the putter is not truly perpendicular to the direction of the hole, and the ball is off the center of gravity. To achieve a perfect alignment every time, a finely adjusted machine tool is needed. Since hand and eye coordination of a human being is much less precise than a machine, a mistake will occur and a missed putt is the result. The present invention is directed to reducing the small inaccuracies that occur with the prior art putters and automatically compensating for mis-struck putts.

SUMMARY OF INVENTION

Accordingly, it is a primary object of the present invention to give improved golf putters provision automatically to compensate misaligned and mis-struck putts in a short putting situation.

A putter consists of a putter head about four to five inches long with some type of weight distribution and total weight ranging between fifteen and eighteen ounces. The putting face of a putter is horizontally flat and has two to four degrees of loft. There are many putter designs in the market each claiming why it is superior to others. However, for the short putting situation, the most important attribute of a putter has to be how tolerant making up the infinitesimal and almost invisible error in positioning the face angle and the clubhead path a player makes when the player aims and strokes a ball. If there is a putter with a face shaped such a way that the ball is always aimed toward the center of the hole, probability of making the hole increases significantly even when a player makes small error in aiming the ball toward the hole.

The putter of the present invention differs from any other conventional or unconventional style putters in the market today. The putter is precision machined to form a concave horizontal face from the heel to toe of the hitting face. The curvature of the concave horizontal face may range an arc of a five to a one-feet radius circle with the center point at the center of the hole. Another way to describe the present invention is the putter having curvature of the horizontal face ranging from the reciprocal of five feet to the reciprocal of one foot. The curvature is defined as the reciprocal of the radius of a circle.

The best way to hit the golf ball in a short putt is like a pendulum. The most golfers cannot do that consistently, but they tend to swing in an arc. Depending on when the putter strikes the ball in that arc, the putter face may be either slightly open or slightly closed at the impact. Because the concave putter always aims a ball toward the center of the hole, slightly open or closed face hit is compensated enough to make the ball to drop into the hole.

Additionally, for right-handed golfers with conventional putters, balls stroked on the inside the sight line toward the heel will travel left of the intended line to the hole. Previous tests show that an average golfer almost always impacts on the toe side of the sight line making the ball to travel right of the intended line to the hole. This is so because the player never looks down the putter head and ball directly above, but slightly the heel side of the sight line. The amount of the offset is very small and almost invisible; but, a small misalignment will result the missed putt. Again, the concave putter will compensate the small misalignment and make the ball drop into the hole by automatically aiming the ball toward the center of the hole. Tests performed on a flat putting green showed that putts stroked with a straight putter resulted in 20 percent traveling on a line left of center and 20 percent traveling right of the center. Of putts stroked with the concave putter, Only 10 percent went left of center and 10 percent went right of the center—a statistically significant improvement.

DETAILED DESCRIPTION OF THE INVENTION

Figure 1:
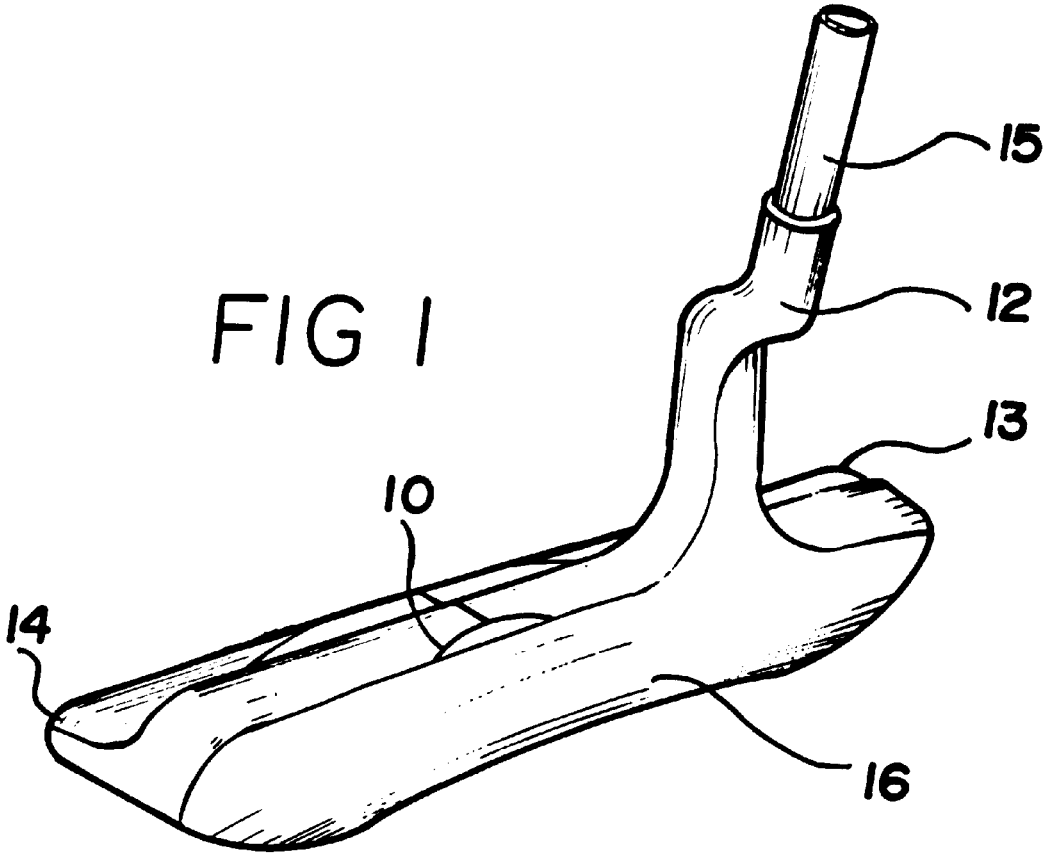
FIG. 1 is a perspective view of a putter made by present invention having the concave horizontal putting face.
Figure 2:
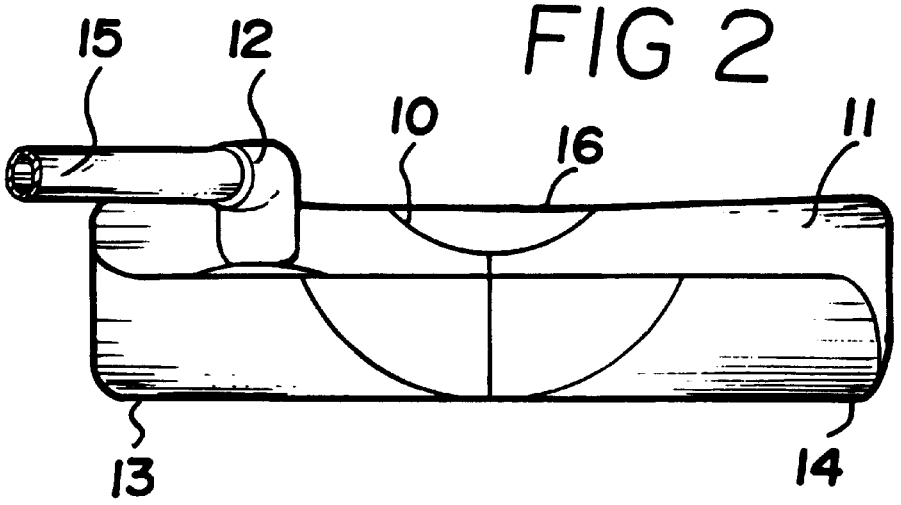
FIG. 2 is a top plan view of a putter of the present invention.
Figure 3:
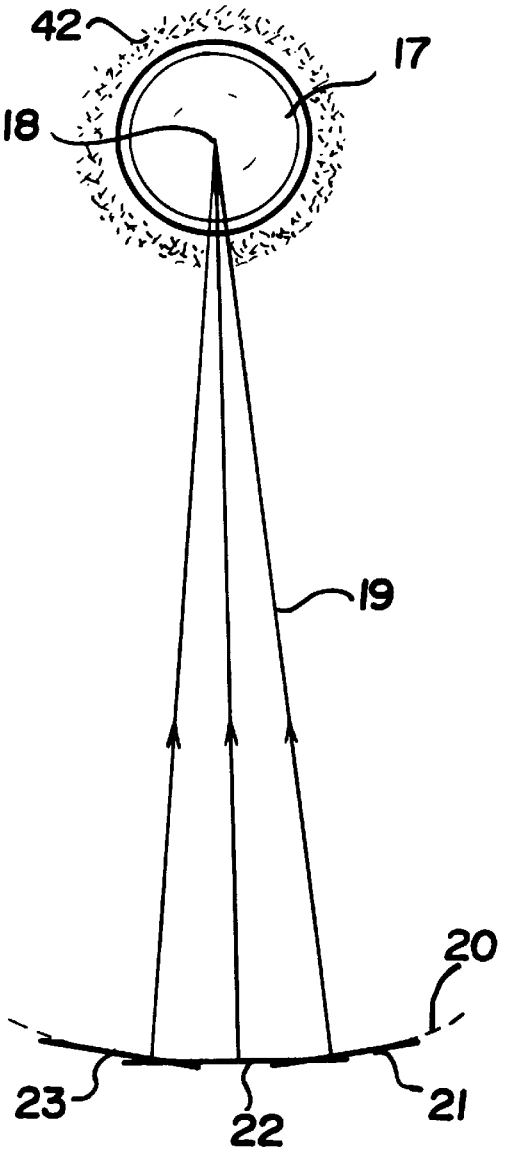
FIG. 3 is a view of an arc formed by a circle drawn from a center of the hole.

Reference is now made to the drawing figures showing the improved golf putter 11 illustrated in FIG. 1 and FIG. 2. The putter shown in the drawing is a typical heel and toe weighted putter, but the putter of any other configuration such as a blade-type putter may be used. Regardless of the type, all putters have a front face 16 which is used to strike the ball, a heel 13, a toe 14, a hosel 12, and a shaft 15. In most of the putter design, the horizontal surface of the face 16 of the putter is flat. In the preferred embodiment of the invention, the face 16 of the putter 11 is curved forming a concave horizontal surface. Curvature of the face 16 of the preferred embodiment is an exact curvature of a circle 20 formed with the center 18 of the hole 17 and radius 19 ranging from five feet to three feet in length as illustrated in FIG. 3. Tangential lines 21, 22, 23 drawn any point on the circle 20 represent ideal face angles of a putter in order to hit a ball perfectly aimed at the center of the hole.

Figure 4:
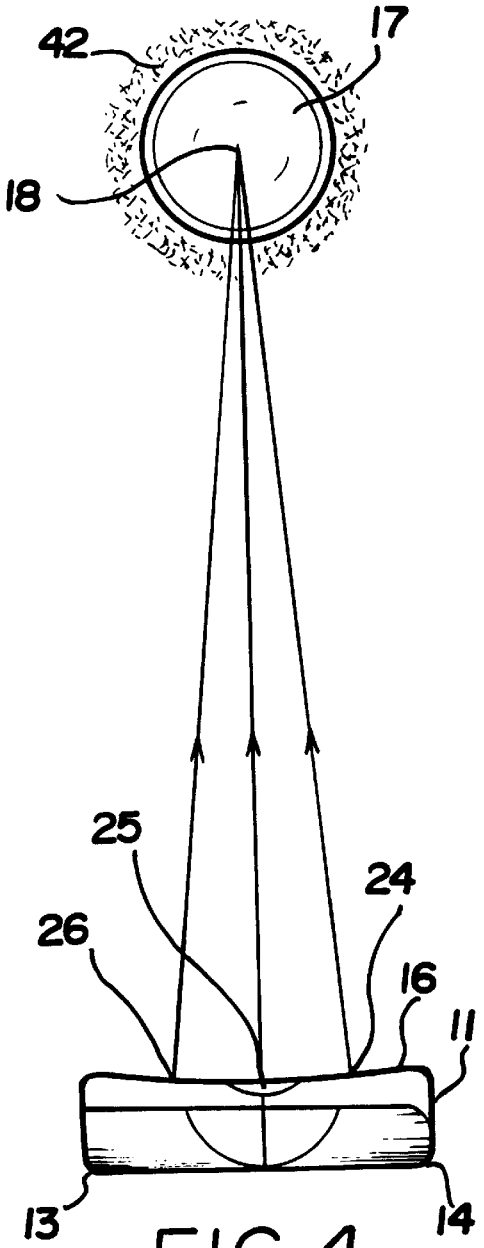
FIG. 4 is a top plan view of a concave horizontal putter with paths of a ball hit at any point of the putter face.
Figure 5:
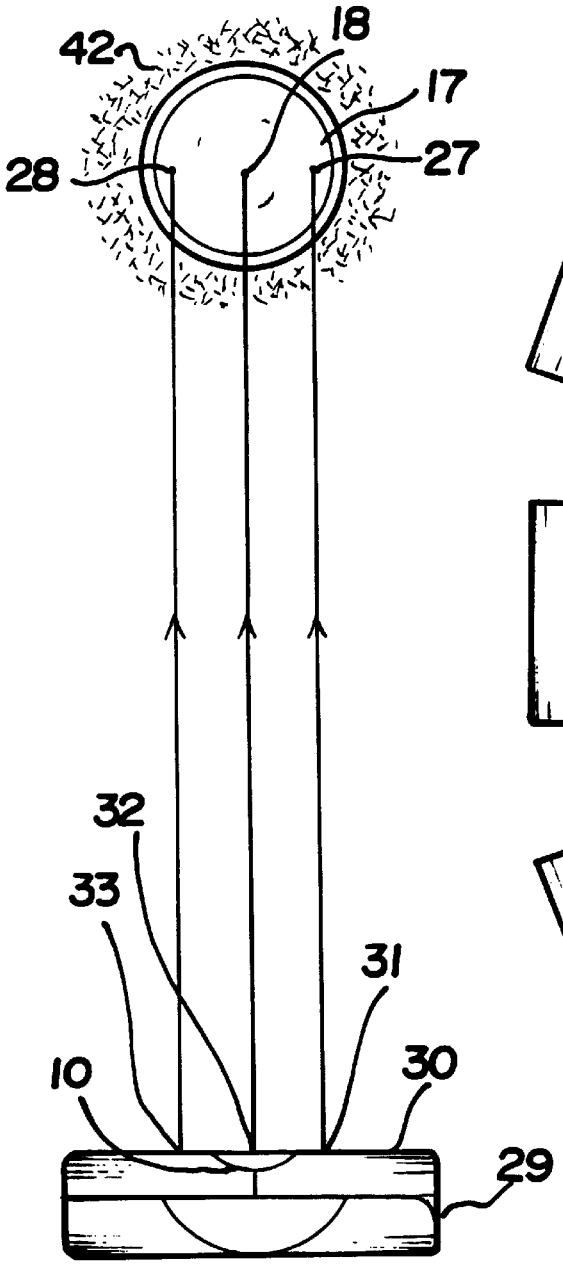
FIG. 5 is a top plan view of a conventional straight faced putter with the path of a ball hit at three different points of the putter face.

FIG. 4 and FIG. 5 schematically illustrate advantages of the preferred embodiments of the invention 11 over a conventional putter 29. When a ball is hit with the putter of present invention 11, the ball will travel toward the center point 18 of the hole 17 no matter where the impact points 24, 25, 26 are as long as the putter face is aligned perpendicularly toward the hole. However, when a ball is hit with a conventional putter 29, only the ball impacted at the center point of the putter 32 will travel toward the center point 18 of the hole 17. The balls impacted at the points 33, 31 offset from the center 32 will end up at points 27, 28 other than the center point 18, increasing the probability of missing the hole. Statistically, balls traveling toward the center point 18 have significantly higher probability of making the hole than balls traveling toward off-center points 27, 28.

Figure 6:
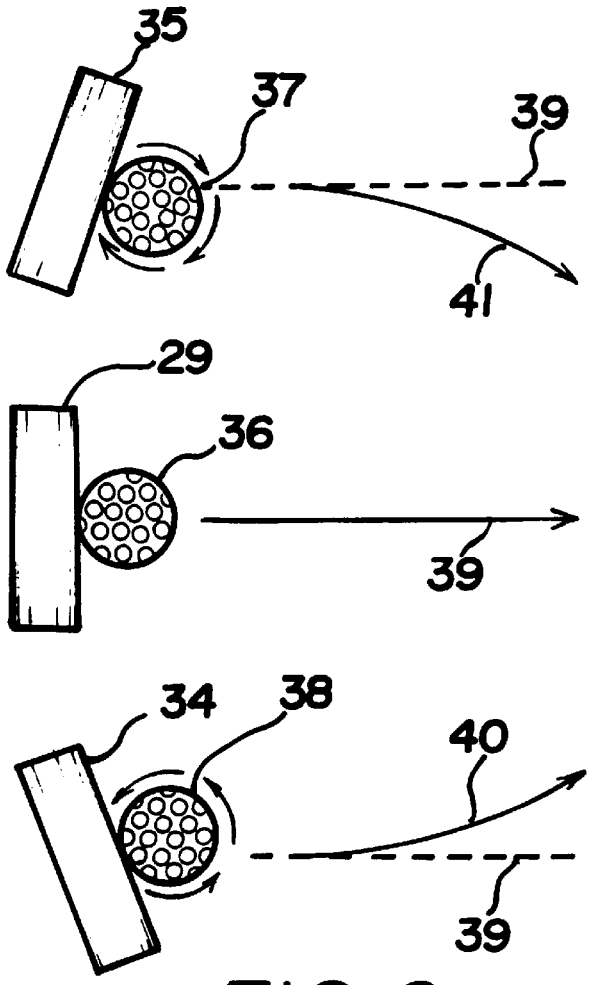
FIG. 6 is a top plan view of balls' travel path when the putter face is open, straight, and close.

FIG. 6 schematically describes paths of a ball hit with the putter's face with a straight face 29, a closed face 35, and open face 34. When a ball 36 is hit with the putter face 29 perpendicular to the hole, the ball 36 will travel straight 39 path with no side spin. When a ball 37 is hit with a closed face putter 35, the ball 37 will have slight clockwise side spin and tends to travel right 41 of the center 39. When a ball is hit with an open face putter 34, the ball 38 will have slight counterclockwise side spin and tends to travel left 40 of the center. Since the present invention tends to aim the center point of the hole, small deviation from the straight path is compensated with the concave putter, and a higher percentage of the ball drops into the cup.

Advantages the preferred embodiment offers over the conventional putter apply any type of putter design. While the preferred embodiments described herein set forth the best mode to practice this invention presently contemplated by the inventors, numerous modification and adaptations of this invention will be apparent to others skilled in the art. Therefore, the embodiments are to be considered as illustrative and exemplary and it is understood that the claims are intended to cover such modifications and adaptations as they are considered to be within the scope of the invention.

What is claimed is:

1. A golf putter for hitting a golf ball a predetermined distance into a hole comprising:

a shaft;

a putter head connected at one end of said shaft, said putter head having top, bottom, rear, and opposing edge faces, and a striking face for striking said golf ball, said striking face having a substantially concave profile between said edge faces, with a radius of curvature defined by a function equal to the distance from said striking face to said hole.

2. The putter of claim 1, wherein said top face of said putter has a marking formed therein, said marking occurring solely on said top face, at least a portion of said marking having a radius of curvature ranging from approximately the radius of curvature of a golf ball to five feet and having starting and ending points at said striking face.

3. The putter of claim 1, wherein said striking face has a substantially convex profile between said top and bottom faces.

4. A golf putter for hitting golf balls having a substantially identical radius of curvature a predetermined distance into a hole comprising:

a shaft;

a putter head having a center of gravity and connected at one end of said shaft, said putter head having top, bottom, rear, and opposing edge faces, and a striking face for striking said golf ball;

said top face having a marking formed thereon, the marking being contained entirely on said top face, at least a portion of said marking being curved and having a center point approximately coinciding with said center of gravity, said marking having a radius of curvature defined by a function equal to the distance from said striking face to said hole.

5. The golf putter of claim 4, wherein said portion of said marking has a radius of curvature ranging from the radius of curvature of a golf ball to five feet.

* * * * *